US006726548B1

(12) United States Patent
Williams

(10) Patent No.: US 6,726,548 B1
(45) Date of Patent: Apr. 27, 2004

(54) PARTS HANGERS FOR ROTATING TABLE BLAST MACHINE

(76) Inventor: Hershell Williams, 16 Glenview Dr., Alexandria, AL (US) 36250

( * ) Notice: Subject to any disclaimer, the term of this patent is extended or adjusted under 35 U.S.C. 154(b) by 242 days.

(21) Appl. No.: 09/934,367

(22) Filed: Aug. 21, 2001

(51) Int. Cl.[7] ..... B24C 3/20
(52) U.S. Cl. ..... 451/84; 451/89
(58) Field of Search ..... 211/163, 166; 451/80, 82, 84, 89, 91, 94, 95, 96

(56) References Cited

U.S. PATENT DOCUMENTS 919,417 A * 4/1909 Suzuki ..... 451/84
4,738,056 A * 4/1988 Suzuki ..... 451/78
5,024,168 A * 6/1991 Stravitz ..... 108/94
5,109,989 A * 5/1992 Kremmin et al. ..... 211/1.55
5,586,927 A * 12/1996 Herbert ..... 451/88
6,520,838 B1 * 2/2003 Shaw ..... 451/38

FOREIGN PATENT DOCUMENTS

JP 10-99553 * 4/1998

* cited by examiner

*Primary Examiner*—Timothy V. Eley
(74) *Attorney, Agent, or Firm*—Rodgers & Rodgers

(57) ABSTRACT

A blast machine having a table with a satellite table rotatably mounted thereon and a support rack upstanding from the satellite table and multiple attachment arms projecting outwardly from the support rack.

8 Claims, 3 Drawing Sheets

PARTS HANGERS FOR ROTATING TABLE BLAST MACHINE

BACKGROUND OF THE INVENTION

Abrasive rotating table blast wheel equipment has been utilized for many years in the treatment of various items by directing shot or small metal spheres at a high velocity to the items in order to remove any burrs or other imperfections created in the manufacturing process. The items to be treated include virtually anything made of metal from quite large items, such as motor vehicle parts, to smaller ones, such as gears and the like.

Generally, when items to be blasted are placed in the blasting machine, they are maintained in a stationary position throughout the blasting process. In order to insure that all surface area receives blasting treatment, the machine had to be stopped, the items turned over to expose the previously unexposed underside, the machine reactivated and the blasting process completed.

BRIEF SUMMARY OF THE INVENTION

By this invention, a rotating table is pivotally mounted on a blast machine such that when the access doors of the machine are open, the table can be swung from the exterior of the machine to the interior of the machine and the access doors closed wherein the abrasive wheel apparatus is then activated. Multiple rotatable support assemblies are mounted on the upper surface of the table for the purpose of receiving items to be blasted.

DETAILED DESCRIPTION OF THE INVENTION

Figure 1:
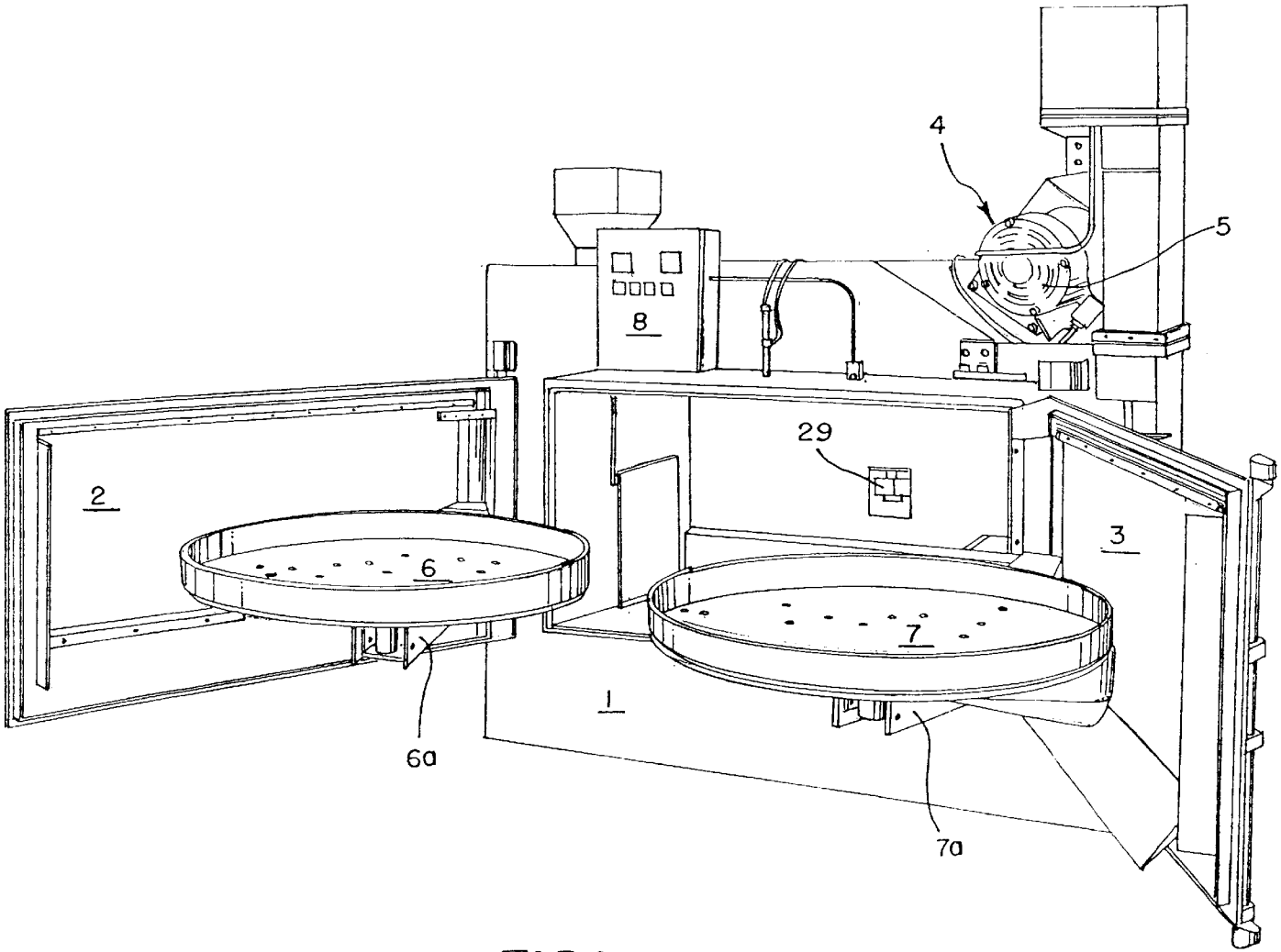
FIG. 1 PRIOR ART
FIG. 1 is a perspective view of a blast machine having a pair of rotating tables.

In the drawings and with particular reference to FIG. 1, the basic elements of an abrasive wheel table blasting machine are depicted. More specifically, the machine includes housing 1 with access doors 2 and 3 pivotally attached thereto. The blast wheel assembly is mounted on housing 1 and is generally designated by the numeral 4 and specifically includes blast wheel 5 for the purpose of directing shot downwardly into the interior of housing 1.

Tables 6 and 7 are rotatably mounted on arms 6*a* and 7*a*, respectively, which in turn are pivotally attached to housing 1. In operation, one of the tables 6 and 7 is swung into position in the interior of housing 1 for any materials disposed thereon to receive shot from the blast wheel assembly 4. When the blasting operation is complete, the table is swung outwardly of housing 1 and the other table is swung into the interior of the housing 1. Therefore, when one table is engaged in the blasting operation, the other table is being prepared with a new array of material to be blasted.

Finally, the entire machine operation is controlled by means of control panel 8. Of course, all the above is well known in the blast system art. These machines may also be purchased from manufacturers with only one table which is known as a plain table and called a double door swing table.

Figure 2:
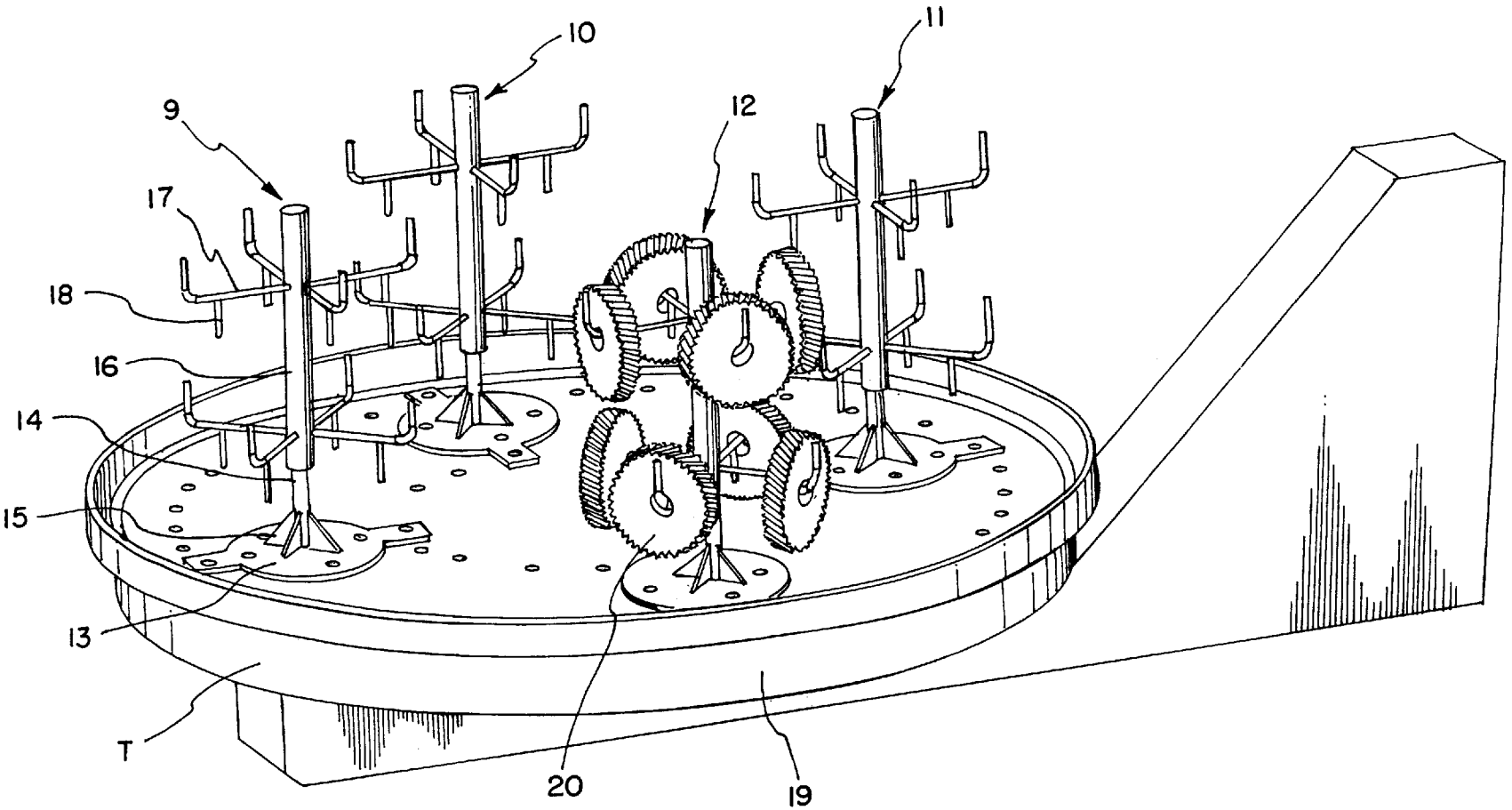
FIG. 2 is a perspective view of one of the tables with multiple support hangers disposed thereon according to this invention.

According to this invention and with particular reference to FIG. 2, table T is of the same construction as either tables 6 or 7, shown in FIG. 1. Specifically, multiple support racks designated generally by the numerals 9, 10, 11 and 12 are mounted on the upper surface of table T. Since support racks 9–12 are of identical construction, only one will be described in detail. With reference to support rack 9, base 13 is provided and is secured to the upper surface of table T. Shaft 14 is affixed at one end to base 13 by means of support 15. Tube 16 is closed at one end and is adapted to be telescoped over shaft 14, thereby allowing it to rotate on shaft 14.

Multiple attachment arms 17 are attached to the outer surface of tube 16 in two vertically spaced sets of attachment arms of four arms each and an attachment hook 18 extends downwardly from each attachment arm 17. Attachment arms 17 are free-wheeling and not powered for turning, but turn from the action of the media impacting the articles hung thereon and the telescoped relationship of shaft 14 and tube 16.

In operation, articles, such as gears 20, are placed on attachment arms 17 and the respective table is swung into the interior of the machine. Although not shown in the drawings, table T is turned in a conventional manner by means of a rotating belt in contact with the outer surface of ring 19. Since the action of the shot causes the support racks to turn, the complete surface area of gears 20 is exposed to the deburring process.

Figure 4:
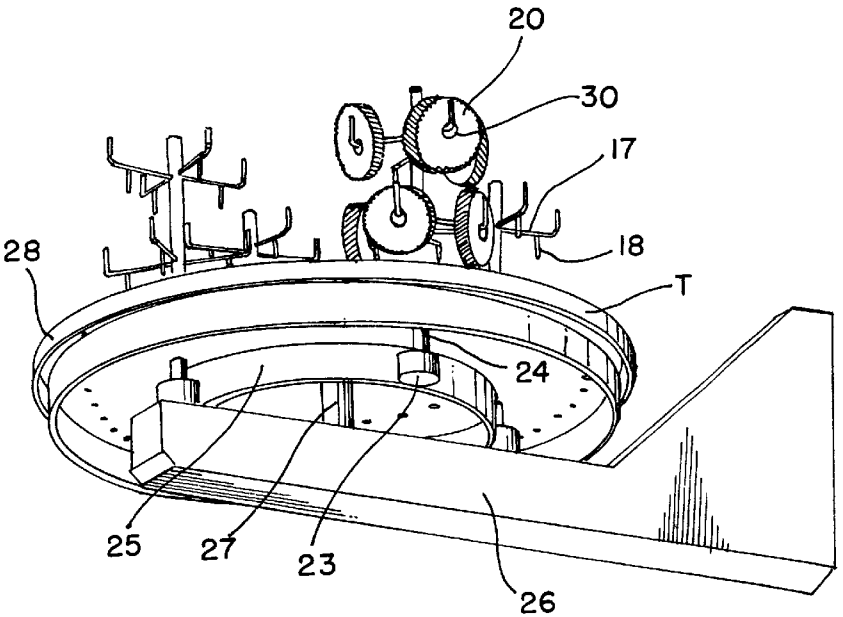
FIG. 4 is a perspective view showing the underside of the wheel shown in FIG. 3.
Figure 3:
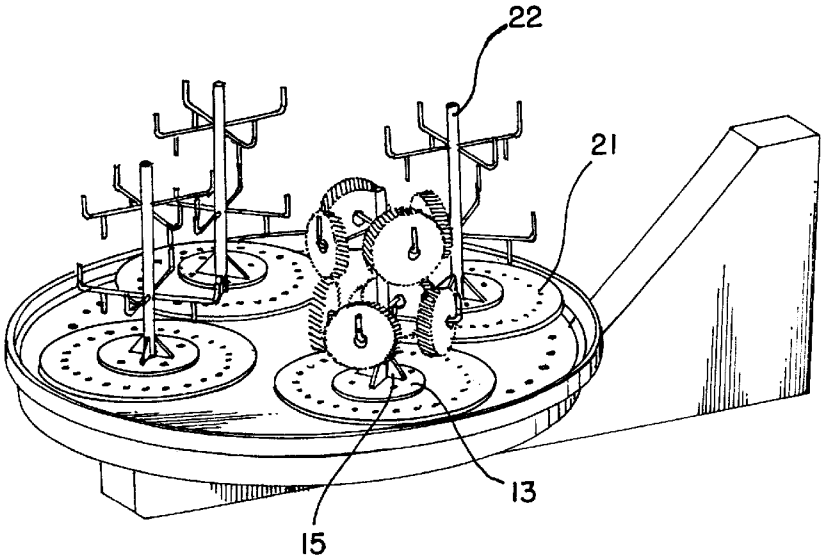
FIG. 3 is a perspective view similar to FIG. 2 showing a modification of the invention.

A modified form of the invention is shown in FIGS. 3 and 4 wherein base 13 is secured to satellite table 21. In this version, rather than having a telescoping post arrangement, single post support rack 22 is attached directly to base 13 by means of support 15. Satellite table 21 is rotatably interconnected to drive wheel 23 by means of shaft 24. For the purpose of providing rotation to drive wheel 23, fixed ring 25 is secured to the underside of table T, the outer surface of which is in contact with drive wheel 23 such that rotation of fixed ring 25 causes the rotation of drive wheel 23 which in turn causes the rotation of satellite table 21 and the respective support rack 22 and attachment arms 17 and attachment hooks 18. Finally table T is rotatably mounted on arm 26 by means of post 27.

In the modified form of this invention, articles to be blasted, such as gears 20, are mounted on support racks 9–12 by means of the cooperation of attachment arm 17 and apertures 30 formed in articles 20. Arm 26 is then swung inwardly of housing 1 into a position whereby drive ring 28, which is fixed to table T, comes into contact with rubber drive wheel 29, as shown in FIG. 1, thereby causing rotation of table T, which simultaneously causes rotation of fixed ring 25 and support racks 9–12 by means of drive wheel 23. Therefore, by this means, all surfaces of articles 20 are exposed to the shot, which is dispensed conventionally from blast wheel 5 and, articles 20 are deburred without having to stop the blast machine and manually reorient articles 20 so as to expose the previously unexposed surfaces thereof.

When it is desired to debur articles larger than gears 20, support racks 9–12 are easily detached from satellite tables 21 so that larger items are placed directly on the satellite table or on pedestal disposed on the satellite table to maximize exposure. For extremely larger articles, such as automobile manifolds, the satellite tables are removed and the articles placed directly on table T in conventional manner.

Therefore, this invention allows the user to combine three separate operations into one machine so as to process parts as heavy as 250 lbs. directly on table T, place smaller 10"×12" parts on satellite tables or attach multiple smaller parts on support racks 9–12. Therefore, this invention effectively combines into one blasting machine three processes which previously required the purchase of three separate machines.

What is claimed is:

1. A blast machine comprising a housing, an arm pivoted to said housing, a table rotatably mounted on said arm, a vertically disposed shaft secured to said table, a tube closed at one end thereof and disposed in a telescoping relationship with said shaft, and at least one attachment arm secured to said tube.

2. A blast machine according to claim 1 wherein an attachment hook is secured to said attachment arm and extends downwardly therefrom.

3. A blast machine according to claim 1 wherein multiple attachment arms are secured to said tube.

4. A blast machine according to claim 1 wherein said shaft is attached to said table by means of a base and support arrangement.

5. A blast machine comprising a housing, an arm pivoted to said housing, a table rotatably mounted on said arm, a fixed ring attached to the underside of said table, a drive wheel driven by the rotation of said fixed ring, a satellite table disposed on the top of said table and being rotatably interconnected to said drive wheel.

6. A blast machine according to claim 5 wherein a support rack is fixed to said satellite table and upstanding therefrom.

7. A blast machine according to claim 6 wherein an attachment arm is fixed to said support rack.

8. A blast machine according to claim 7 wherein an attachment hook is fixed to said attachment arm and extends downwardly therefrom.

* * * * *